US006151756A

United States Patent [19]

Czipri

[11] Patent Number: 6,151,756

[45] Date of Patent: Nov. 28, 2000

[54] BIMINI HINGE

[75] Inventor: John Czipri, Palm Harbor, Fla.

[73] Assignee: Accon Marine, Inc., Clearwater, Fla.

[21] Appl. No.: 09/285,913

[22] Filed: Apr. 2, 1999

[51] Int. Cl.[7] ..... E05D 7/08

[52] U.S. Cl. ..... 16/379; 16/361; 16/371; 16/367

[58] Field of Search ..... 16/379, 366, 367, 16/368, 369, 371, 374, 344, 350, 323, 331, 332, 361

[56] References Cited

U.S. PATENT DOCUMENTS

| | | | |
|---|---|---|---|
| 1,313,726 | 8/1919 | Nicol | 16/367 |
| 1,903,379 | 4/1933 | Hall | 16/367 |
| 3,289,799 | 12/1966 | Bush | 16/405 |
| 4,843,680 | 7/1989 | Cress et al. | 16/369 |
| 5,233,726 | 8/1993 | Cress | 16/336 |
| 5,392,493 | 2/1995 | Youngdale | 16/321 |
| 5,873,149 | 2/1999 | Bonenberger | 16/366 |

*Primary Examiner*—Chuck Y. Mah
*Attorney, Agent, or Firm*—Harold D. Shall

[57] ABSTRACT

A hinge having a housing with a flush mountable flange. A hinge member having pivotally connected upper and lower portions with the lower portion pivotally connected within the housing. A portion of the lower portion is engageable with a slot in the housing for locking the lower portion in an upright position. Upon unlocking the lower portion from the housing the hinge member can be pivoted into a flush relationship with the housing.

5 Claims, 2 Drawing Sheets

BIMINI HINGE

BACKGROUND OF THE INVENTION

1. Field of the Invention

This invention relates to hinges generally and more particularly to a hinge including a housing, which hinge has a pivoting member securable to a bimini supporting bow when in its operative position, and which member is receivable within the housing when in its depressed; inoperative position.

2. Description of the Prior Art

Bimini hinges of the prior art present an obstruction to a boat operator when such hinge is on the top surface of a portion of the boat, such as when on the top of the gunnel or top of the windshield. This results, when the bimini is removed and not in use, in the hinge projecting above such surface and interfering with the operators use of the boat.

It is, therefore, an object of this invention to provide such a hinge for mounting on an upper surface which does not interfere with the operator when the hinge is not in use.

SUMMARY OF THE INVENTION

A hinge for the upper surface of a portion of a boat wherein the hinge includes a housing and a pivoting member pivotally secured to the housing. The housing has base portion for securing to the upper surface in a substantially flush relationship and receiving portion depending from the base portion. The pivoting member is pivotally mounted in the receiving portion, and when operative, a securing portion thereof projects from the base portion and is operative to have the bow of a bimini top secured thereto. When the pivoting members is not in use, means locking the same upright relative to the housing can be disengaged and the pivoting portion moved downwardly into the receiving portion.

DETAILED DESCRIPTION OF THE PREFERRED EMBODIMENT

A hinge assembly shown generally at 10 includes a base portion 12 and a pivoting member 14. The pivoting member 14 has an upper securing portion 15 and a lower securing portion 16.

Figure 1:
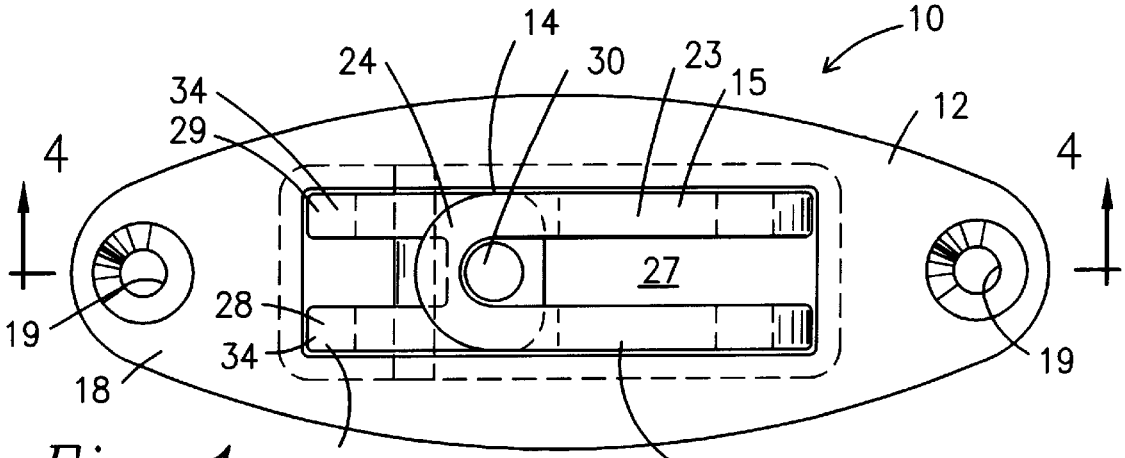
FIG. 1 is a plan view of a hinge according to this invention or with the pivoting members in its downward position.
Figure 2:
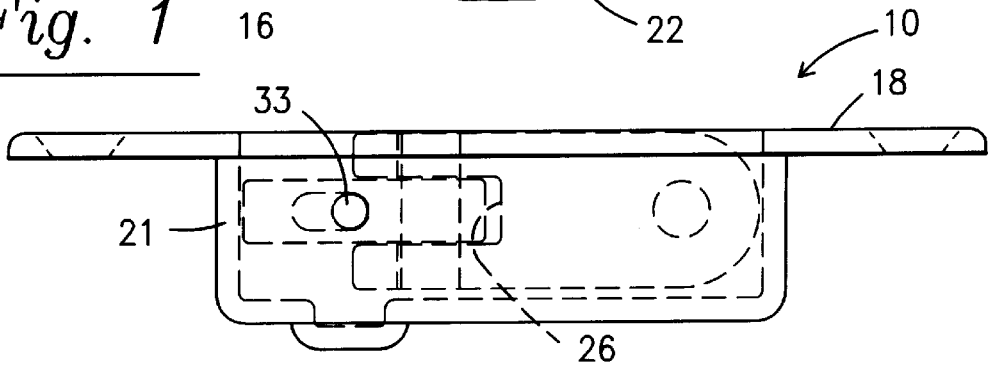
FIG. 2 is a side elevational view of the hinge of FIG. 1.
Figure 4:
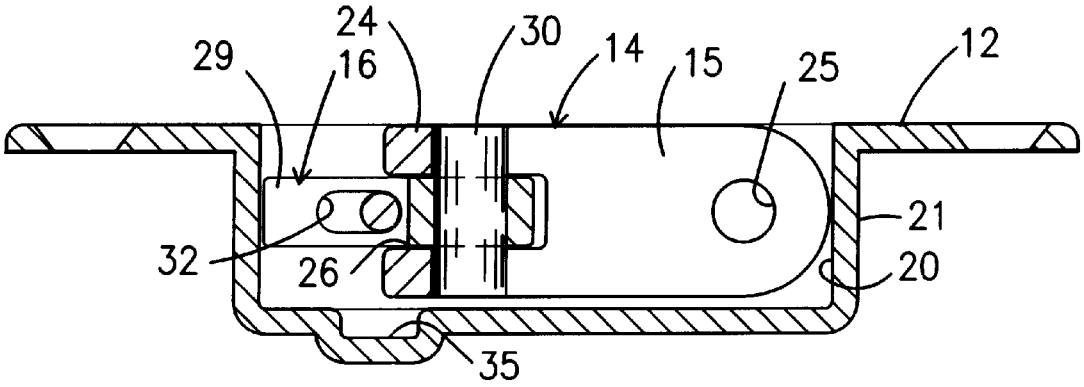
FIG. 4 a cross sectional view taken along the lines 4—4 in FIG. 1.
Figure 5:
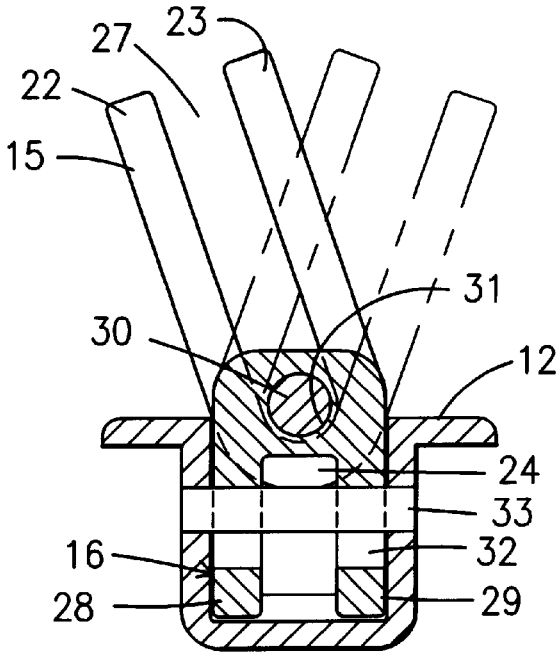
FIG. 5 is a cross sectional view taken above the line 5—5 in FIG. 3.

The base portion 12 has a flush mountable flange 18 with a pair of longitudinally opposed bolt holes 19 and has a central closed cavity 20 surrounded by a depending housing 21 which depends from the flange of the base portion 12, and as seen in FIGS. 1, 2 and 4, the cavity is operative to receive the pivoting member 14 when in its depressed, flush and inoperative position. The upper securing portion 15 of the pivoting member 14, as seen in FIGS. 1 and 5, has a generally "U" shaped configuration with a pair of laterally spaced legs 22 and 23 extending from a bottom portion 24. The legs 22 and 23 have a laterally extending hole 25 extending therethrough so that a conventional bimini's attaching member (not shown) can fit between the legs 22 and 23 of the upper securing portion and a bolt (not shown) passed between the hole 25 and a registering hole (not shown) in the bimini's attaching member.

The bottom portion 24 of the pivoting member 14 has a axially extending slot 26 therein projecting inwardly from the bottom thereof. An inverted "U" shaped lower securing portion 16 which serves as a fixable hinge pivot, has a pair of depending legs 28 and 29. The top of the portion 16 fits into the slot 26 in the upper portion 15, and a pivot pin 30 fits within the space 27 between the legs 22 and 23 of the upper portion 14 immediately above the bottom 24 thereof and the pivot pin 30 passes through the space between the legs 22 and 23, and is suitably secured, as buy a pressed fit, into a registering opening 31 in the top of the lower securing portion 16. The pivot pin 30 allows limited lateral pivoting of the member 15 when the latter is in its upright position as seen in FIG. 5; such movement being limited by engagement with the base portion 12.

Figure 3:
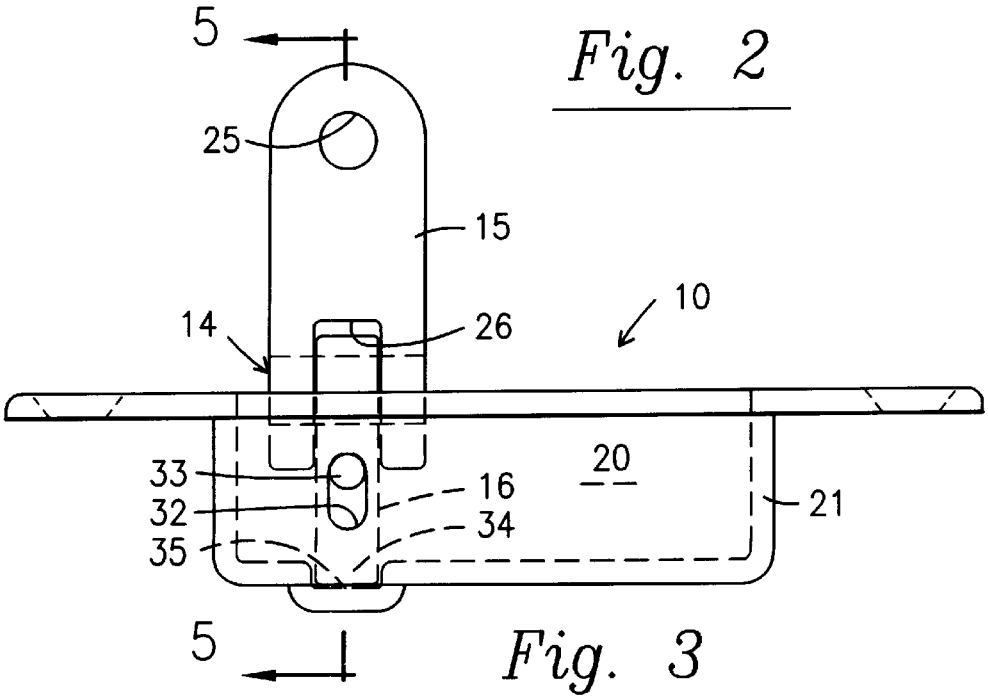
FIG. 3 is a side elevational view with the pivoting member in its operative upright position.

The lower securing portion 16 has an axially elongated and laterally extending slot shaped opening 32 therein, which slot receives a pivot pin 33, the ends of which pin are suitably secured (as by a pressed fit) in the lateral side walls of the housing 21, whereby the member 14 can pivot fore and aft. When the lower securing portion 16 is in its upright downward position as seen in FIGS. 3 and 5, the pin 33 will be at the top of the slot 32 and the bottom 34 of the legs 28 and 29 will fit into a groove 35 formed in the bottom of the housing 21, which fit locks the member 14 against fore and aft pivoting.

To lower the pivoting member 14 to its depressed position of FIGS. 1 and 2, the bimini (not shown) is unsecured from the hole 25 in the upper securing portion 15, the member 14 is lifted vertically so that the bottom 34 of the legs 28 and 29 are removed from the groove 35. The pivoting member is then pivoted downward to its depressed position wherein the top thereof is flush with the top of the flange 18. To raise the pivoting member 14, the above operation is reversed.

Although the above description relates to a presently preferred embodiment, numerous changes can be made therein without departing from the scope of this invention as claimed in the following claims.

What is claimed is:

1. A hinge having a longitudinal axis and having an upright operative position and a depressed flush inoperative position, comprising, a) a housing member with a longitudinal axis coplanar with said hinge axis and having
   1) a flush mountable flange and
   2) a housing carried by said flange and depending therefrom, b) a pivoting member carried by said housing and having an upright position wherein a potion there of projects from said housing and a depressed position wherein it is depressed within said housing, said pivoting member having
   1) an upper securing portion for securing an element to be mounted,
   2) a lower securing portion,
   3) means pivotally securing said upper and lower portions for lateral pivoting movement about the longitudinal axis of said housing member, and
   4) means pivotally securing said lower portion to said housing member within said housing for pivoting about an axis which extends laterally relative to the longitudinal axis of said housing member, and c) locking means formed as a portion of said housing and said lower portion and acting between said housing and said lower portion for locking said lower portion in its upright position.

2. A hinge according to a claim 1 wherein said housing has a closed bottom and said locking means includes a slot in said closed bottom engageable with said lower securing portion for locking said lower portion in its upright position.

3. A hinge according to claim 2 wherein said upper securing portion has a top and a bottom and has an opening adjacent the top thereof which extends laterally relative to the longitudinal axis of said housing, and a passage way in the bottom thereof, said lower portion has a top and a bottom and a pivot pin carried by said top of said lower portion and passing through said passage way for pivotally securing said upper and lower portions.

4. A hinge according to claim 3 wherein said lower portion has a slot therein which extends axially relative to the longitudinal axis of said housing and which slot is vertically elongated when said lower portion is in its upright position and a pin carried by said housing passes through said slot pivotally mounting said lower member to said housing while said slot allows movement in a vertical direction when said lower portion is in its upright position.

5. A hinge according to claim 2 wherein said lower portion has a slot therein which extends laterally relative to the longitudinal axis of said housing and which slot is vertically elongated when said lower portion is in its upright position and a pin carried by said housing passes through said slot pivotally mounting said lower member to said housing while said slot allows relative movement in a vertical direction when said lower portion is in its upright position.

* * * * *